US007403177B2

(12) United States Patent
Tanada et al.

(10) Patent No.: US 7,403,177 B2
(45) Date of Patent: Jul. 22, 2008

(54) DISPLAY DEVICE, DRIVING METHOD THEREOF, AND ELECTRONIC APPARATUS

(75) Inventors: Yoshifumi Tanada, Kanagawa (JP); Aya Anzai, Kanagawa (JP)

(73) Assignee: Semiconductor Energy Laboratory Co., Ltd., Atsugi-shi, Kanagawa-Ken (JP)

( * ) Notice: Subject to any disclaimer, the term of this patent is extended or adjusted under 35 U.S.C. 154(b) by 312 days.

(21) Appl. No.: 10/717,970

(22) Filed: Nov. 21, 2003

(65) Prior Publication Data

US 2004/0263499 A1 Dec. 30, 2004

(30) Foreign Application Priority Data

Nov. 29, 2002 (JP) ..... 2002-349043

(51) Int. Cl.

| | |
|---|---|
| ***G09G 3/30*** | (2006.01) |
| ***G09G 3/10*** | (2006.01) |
| *H01J 1/62* | (2006.01) |
| *H01J 63/04* | (2006.01) |

(52) U.S. Cl. ..... 345/76; 315/169.3; 313/506

(58) Field of Classification Search ..... 345/76–83, 345/204; 315/169.1–169.4; 313/503, 505, 313/506

See application file for complete search history.

(56) References Cited

U.S. PATENT DOCUMENTS

| | | | | |
|---|---|---|---|---|
| 5,837,391 | A * | 11/1998 | Utsugi | 428/690 |
| 6,372,608 | B1 | 4/2002 | Shimoda et al. | |
| 6,429,601 | B1 | 8/2002 | Friend et al. | |
| 6,597,348 | B1 | 7/2003 | Yamazaki et al. | |
| 6,909,442 | B2 * | 6/2005 | Hiyama et al. | 345/690 |
| 6,965,361 | B1 * | 11/2005 | Sheats et al. | 345/82 |
| 2001/0035863 | A1 | 11/2001 | Kimura | |
| 2002/0075216 | A1 | 6/2002 | Satake | |
| 2003/0058210 | A1 | 3/2003 | Yamazaki et al. | |
| 2003/0107537 | A1 * | 6/2003 | Ochi et al. | 345/83 |
| 2003/0117348 | A1 * | 6/2003 | Knapp et al. | 345/76 |
| 2004/0129933 | A1 * | 7/2004 | Nathan et al. | 257/40 |
| 2004/0222746 | A1 * | 11/2004 | Winters | 315/167 |

FOREIGN PATENT DOCUMENTS

| | | |
|---|---|---|
| EP | 0 905 672 | 3/1999 |
| EP | 1 103 946 A2 | 5/2001 |
| EP | 1204087 | 5/2002 |
| EP | 1231593 | 8/2002 |
| JP | 57-132189 | 8/1982 |
| JP | 59-040996 | 3/1984 |

(Continued)

OTHER PUBLICATIONS

PCT Search Report, PCT/JP03/14539; Dec. 16, 2003, 2 pages.

(Continued)

*Primary Examiner*—Amr Awad
*Assistant Examiner*—Stephen G Sherman
(74) *Attorney, Agent, or Firm*—Fish & Richardson P.C.

(57) ABSTRACT

It is characterized in that the image signal selecting the light-emission/no light-emission of the first to third light-emitting elements 112 to 114 formed by lamination is input through only the transistor for switching 107, and the specific light-emission is selectively emitted by controlling the potential of the first to third current supply lines 103 to 105.

12 Claims, 14 Drawing Sheets

FOREIGN PATENT DOCUMENTS

| | | | |
|---|---|---|---|
| JP | 04-022990 | | 1/1992 |
| JP | 2000-147569 | | 5/2000 |
| JP | 2001-343933 | | 12/2001 |
| JP | 2002-297083 | | 10/2002 |
| JP | 2002287664 A | * | 10/2002 |

OTHER PUBLICATIONS

International Preliminary Examination Report (PCT/JP03/14539), Mar. 2, 2004, partial translation, 9 pages.
Search Report (Application No. 03772788.0), dated Feb. 10, 2006, 3 pages.

* cited by examiner (A) PRIOR ART (B) PRIOR ART

DISPLAY DEVICE, DRIVING METHOD THEREOF, AND ELECTRONIC APPARATUS

TECHNICAL FIELD

The present invention relates to a display device disposed with light-emitting elements, particularly a display device disposed with a display portion that conducts multicolor display, and to a driving method thereof.

BACKGROUND ART

In recent years, the research and development of display devices using self-emitting elements represented by electroluminescence (EL) elements and the like instead of liquid crystal displays (LCD), which include pixels using liquid crystal elements, has advanced. These light-emitting devices utilize advantages such as high-resolution due to the fact that they are self-emitting, they have a wide viewing angle, and they are thin and lightweight because they do not require a backlight, and therefore they are expected to have a wide use as display screens for mobile telephones and as display devices.

Also, increasing sophistication is demanded in display devices themselves due to the diversification of the purposes of use of such as mobile telephones, and color display devices that conduct multicolor display are already being widely used.

FIG. 5(A) shows an example of a common color display device. A pixel portion 501, a source signal line drive circuit 502 and a gate signal line drive circuit 503 are formed on a substrate 500. The input of signals to the drive circuits and the supply of an electrical current to the pixel portion 501 are conducted from the outside via a flexible printed circuit (FPC) 504.

In FIG. 5(A), the portion represented by the dotted line frame 510 is one pixel. FIG. 5(B) shows an enlarged view of part of the pixel portion 501. Each pixel respectively includes a source signal line 511 for inputting an image signal, a gate signal line 512 for conducting line selection, a current supply line 513 for supplying an electrical current to an EL element 516, a transistor 514 for switching, a transistor 515 for driving, a power line 517 and a retention volume 518. There is description in Patent Document 1 in relation to a circuit configuration where one pixel is configured using two transistors and which drives a load (here, the EL element is used as an example).

As one method that conducts multi-gradation display in such a display device using EL elements, there is a driving method where digital gradation and time gradation are combined (see Patent Document 2). According to this method, there is the advantage that it is difficult for fluctuations in the characteristics of the elements to influence image quality because it suffices as long as two states, the light-emitting state and the non-light-emitting state, of the EL elements can be controlled.

(Patent Document 1) Japanese Patent Laid-open No. 2000-147569

(Patent Document 2) Japanese Patent Laid-open No. 2001-343933

In the case of conducting color display, the respective emissions of R, G and B are controlled using, for example, three adjacent pixels represented by the dotted frame 520 in FIG. 5(B), and multicolor display is conducted by mixing these colors. In other words, three pixels are required for a 1-bit display.

In comparison to pixels in the case of conducting a monochrome display, the pixels of a color display device with which multicolor display is possible have many constituent elements, and the area occupying the display region is also large. Thus, the aperture ratio drops. In order to obtain a desired luminance, it is necessary to raise the emission luminance by the amount that the aperture ratio has dropped. In order to raise the emission luminance, it is necessary to raise the current density per pixel, but this leads to a reduction in the life of the EL elements.

DISCLOSURE OF THE INVENTION

The present invention has been made in light of the above problem and provides a display device with which multicolor display is possible using a new configuration.

In order to solve the aforementioned problem, the following means are taken in the present invention.

Whereas one pixel has conventionally been configured as three RGB sub-pixels, in the present invention, EL elements that emit respective emission colors of R, G and B are laminated and formed. The source signal line and the gate signal line are not disposed for R, G and B; rather, one signal line is shared by three pixels.

The emissions of R, G and B are conducted in respective different periods. In other words, the field sequential format, where R, G and B are sequentially emitted in one frame period, is used.

As for the selection of RGB emission with respect to image signal input and line selection, RGB are selected by selecting the potential of the current supply lines so that a desired emission color can be obtained.

The configuration of the present invention is described below.

A display device of the present invention includes a pixel portion where pixels including a plurality of light-emitting elements that emit different emission colors are arranged in a matrix, and the display device of the present invention is characterized in that any one of the plurality of light-emitting elements is selected to sequentially emit light.

A display device of the present invention includes a pixel portion where pixels that include first to n-th (where n is a natural number, $2 \leqq n$) light-emitting elements that emit different emission colors are arranged in a matrix, and the display device of the present invention is characterized in that any one of the first to n-th light-emitting elements is sequentially selected and emits light.

A display device of the present invention includes a pixel portion where pixels including first to (n+1)th (where n is a natural number, $2 \leqq n$) pixel electrodes and first to n-th light-emitting elements that are disposed so as to be sandwiched between the first to (n+1)th pixel electrodes and emit different emission colors are arranged in a matrix. In addition, the pixels include first to n-th current supply lines, a power line and first to n-th transistors for driving. Moreover, the display device of the present invention is characterized in that the m-th (where m is a natural number, $1 \leqq m \leqq n$) pixel electrode is electrically connected to the m-th current supply line via the m-th transistor for driving, the (n+1)th pixel electrode is electrically connected to the power line, the display device includes at least first to n-th light emission periods, and in the m-th light emission period, a difference in potential is disposed between the pixel electrodes sandwiching the m-th light-emitting element, so that the m-th light-emitting element selectively emits light.

A display device of the present invention includes a pixel portion where pixels including first to (n+1)th (where n is a natural number, 2≦n) pixel electrodes and first to n-th light-emitting elements that are disposed so as to be sandwiched between the first to (n+1)th pixel electrodes and emit different emission colors are arranged in a matrix. In addition, the pixels include a source signal line, a gate signal line, first to n-th current supply lines, a power line, a transistor for switching and first to n-th transistors for driving. Moreover, the display device of the present invention is characterized in that a gate electrode of the transistor for switching is electrically connected to the gate signal line, a first electrode is electrically connected to the source signal line, a second electrode is electrically connected to gate electrodes of the first to n-th transistors for driving, the m-th (where m is a natural number, 1≦m≦n) pixel electrode is electrically connected to the m-th current supply line via the m-th transistor for driving, and the (n+1)th pixel electrode is electrically connected to the power line.

A display device of the present invention further includes a gate signal line for erasure and a transistor for erasure. Moreover, the display device of the present invention is characterized in that a gate electrode of the transistor for erasure is electrically connected to the gate signal line for erasure, a first electrode is electrically connected to the gate electrodes of the first to n-th transistors for driving, and a second electrode is electrically connected to any one of the first to n-th current supply lines.

A display device of the present invention further includes a gate signal line for erasure, a transistor for erasure, and a retention volume line. Moreover, the display device of the present invention is characterized in that a gate electrode of the transistor for erasure is electrically connected to the gate signal line for erasure, a first electrode is electrically connected to the gate electrodes of the first to n-th transistors for driving, and a second electrode is electrically connected to the retention volume line.

A display device of the present invention further includes a gate signal line for erasure and first to n-th transistors for erasure. Moreover, the display device of the present invention is characterized in that gate electrodes of the first to n-th transistors for erasure are electrically connected to the gate signal line for erasure and are disposed between the first to n-th pixel electrodes and the first to n-th transistors for driving.

A display device of the present invention is characterized in that the second to n-th pixel electrodes all comprise a transparent layer.

A display device of the present invention is characterized in that the first to n-th light-emitting elements and the first to (n+1)th pixel electrodes are laminated.

A method of driving a display device of the present invention is a method of driving a display device including a pixel portion where pixels including a plurality of light-emitting elements that emit different emission colors are arranged in a matrix. Moreover, the method of driving a display device of the present invention is characterized in that any one of the plurality of light-emitting elements is selected to sequentially emit light.

A method of driving a display device of the present invention is a method of driving a display device including a pixel portion where pixels including first to n-th (where n is a natural number, 2≦n) light-emitting elements that emit different emission colors are arranged in a matrix. Moreover, the method of driving a display device of the present invention is characterized in that any one of the first to n-th light-emitting elements is selected to sequentially emit light.

BEST MODE FOR CARRYING OUT THE INVENTION

Embodiment Mode 1

Figure 1:
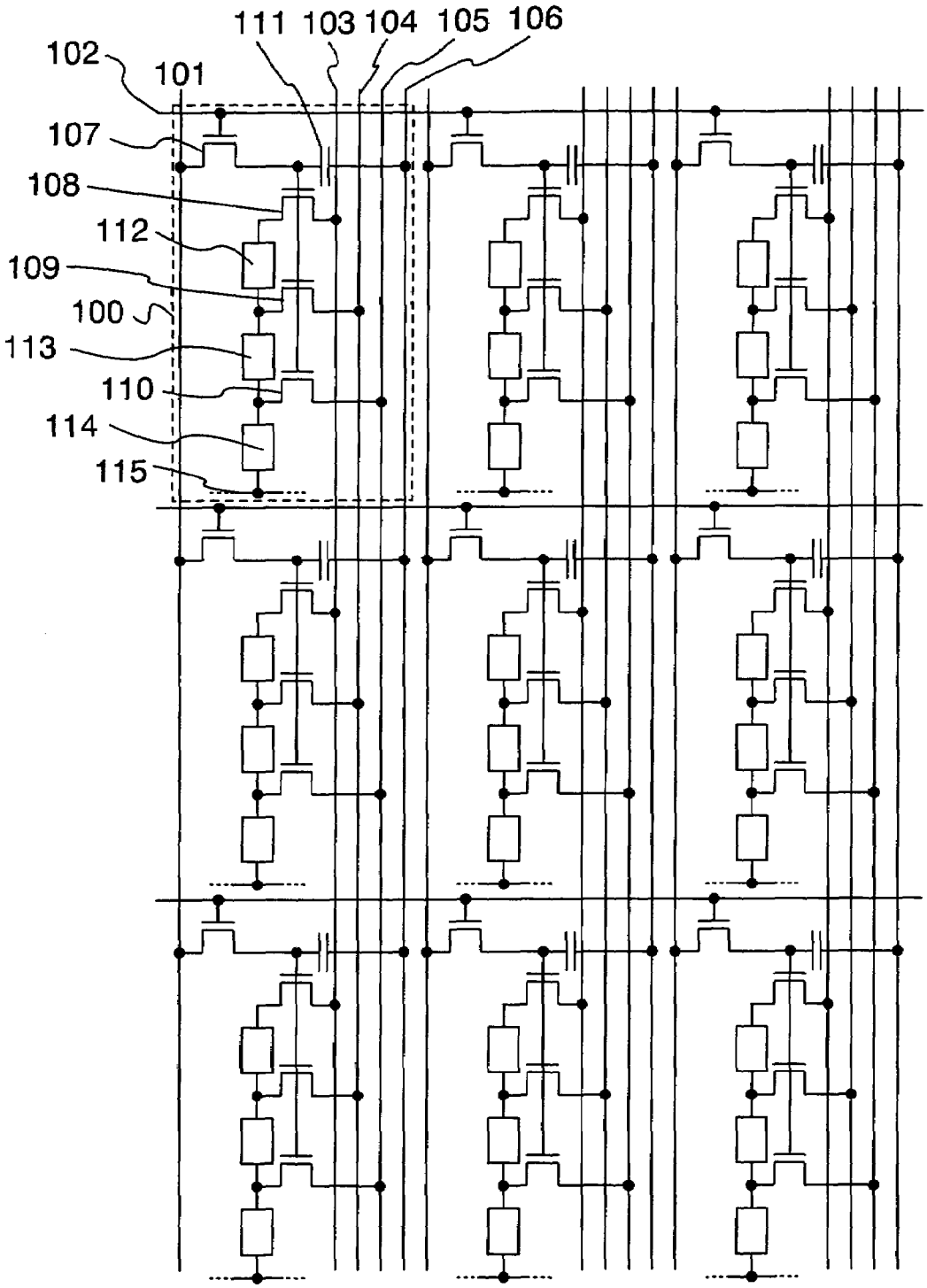
FIG. 1 is a diagram showing an embodiment mode of the present invention.

FIG. 1 shows the configuration of a pixel portion in a display device of the present invention. Although the present invention will be described hereinafter while using, as an example of a transistor, a thin film transistor (referred to below as a "TFT") formed on an insulator, the present invention is not limited thereto and includes all cases where the transistor is configured by using an organic thin film transistor, a MOS transistor, a molecular transistor or the like. Also, because it is difficult to separate the source region and the drain region in a TFT due to the configuration and operating conditions thereof, one will be referred to as a first electrode and the other will be referred to as a second electrode. Although the present invention will be described using EL elements as an example of light-emitting elements, the present invention is not limited thereto and includes, as targets, elements with which an electrical current can be generated by imparting a potential difference between the two terminals so that the elements can emit light due to the electrical current.

In FIG. 1, the portion surrounded by the dotted frame 100 is one pixel. Each pixel respectively includes a source signal line 101, a gate signal line 102, first to third current supply lines 103 to 105, a retention volume line 106, a TFT for switching 107, first to third TFTs for driving 108 to 110, a retention volume 111, first to third EL elements 112 to 114, and a power supply line 115.

The gate electrode of the TFT for switching 107 is electrically connected to the gate signal line 102, the first electrode is electrically connected to the source signal line 101, and the second electrode is electrically connected to the gate electrodes of the first to third TFTs for driving 108 to 110. The first electrode of the first TFT for driving 108 is electrically connected to the first current supply line 103, and the second electrode is electrically connected to the first electrode of the first EL element 112. The first electrode of the second TFT for driving 109 is electrically connected to the second current supply line 104, and the second electrode is electrically connected to the first electrode of the second EL element 113. The first electrode of the third TFT for driving 110 is electrically connected to the third current supply line 105, and the second electrode is electrically connected to the first electrode of the third EL element 114. The retention volume 111 is formed between the retention volume line 106 and the gate electrodes of the first to third TFTs for driving 108 to 110, and retains the potentials of the gate electrodes of the first to third TFTs for driving 108 to 110. Here, the retention volume 111 is formed using the independent retention volume line 106, but the present invention is not particularly limited to this configuration. In other words, the retention volume 111 may be disposed between the gate electrodes of the first to third TFTs for driving 108 to 110 and any constant potential.

The first to third EL elements 112 to 114 are formed by lamination. In other words, the second electrode of the first EL element 112 doubles as the first electrode of the second EL element 113, and the second electrode of the second EL element 113 doubles as the first electrode of the third EL element 114. The second electrode of the third EL element 114 is electrically connected to the power supply line 115 and has a different potential from those of the first to third power supply lines 103 to 105.

Figure 14:
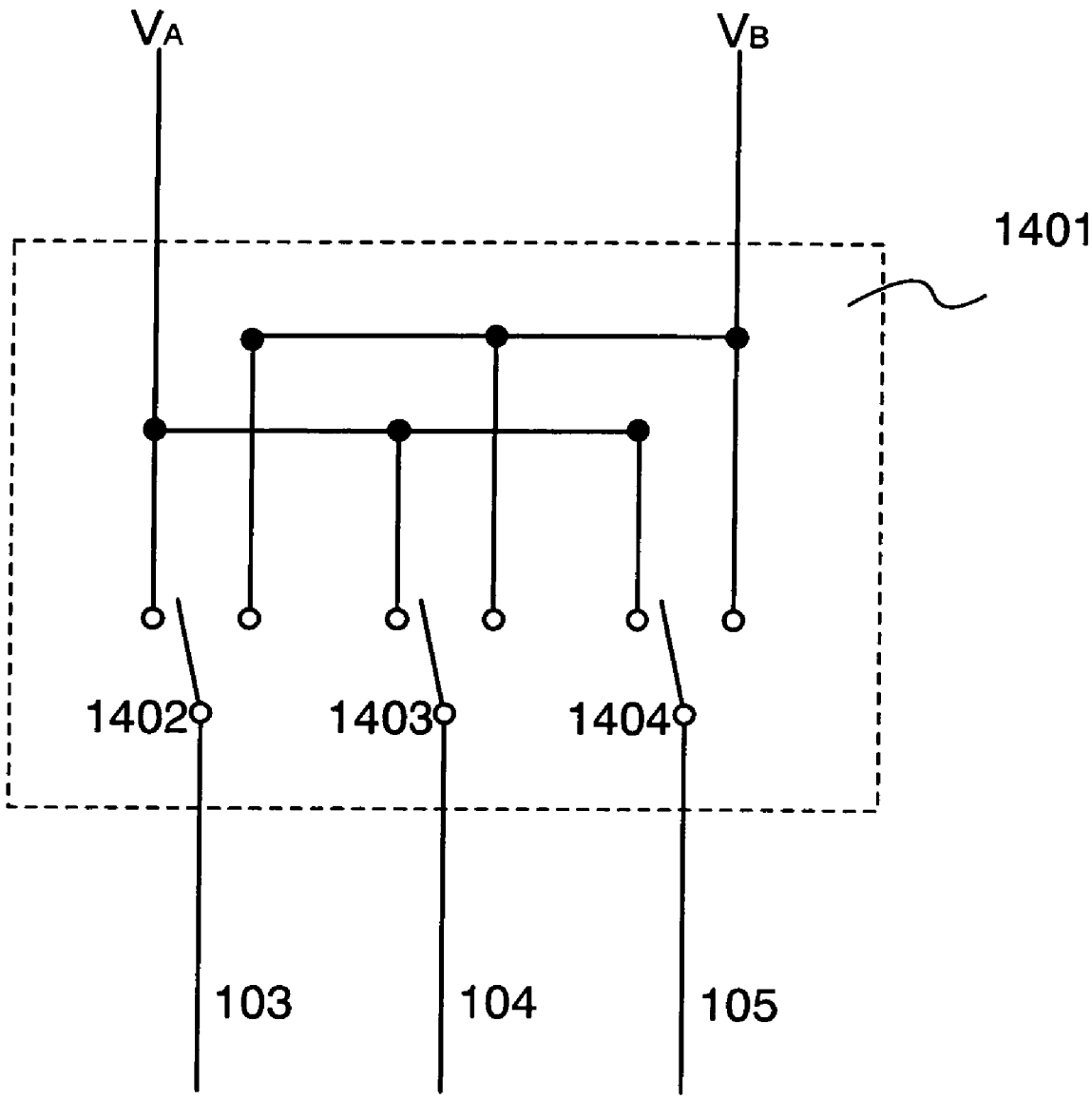
FIG. 14 is a diagram showing a field sequential drive control circuit.

The first to third current supply lines 103 to 105 are connected to a control circuit 1401 of FIG. 14. The control circuit 1401 switches the connections of switches 1402 to 1404 respectively, whereby it controls the potentials of the current supply lines 103 to 105 to be $V_A$ or $V_B$. Thus, it conducts field sequential driving. The configuration of the control circuit is not limited to FIG. 14. In FIG. 14, the control circuit has a configuration using the two potentials of $V_A$ and $V_B$, but the control circuit may also have a configuration that switches three or more potentials.

With respect to the first to third EL elements 112 to 114, the first electrodes of the second and third EL elements 113 and 114 are both formed by using a transparent conductive material. Also, one of the first electrode of the first EL element 112 and the second electrode of the third EL element 114 is formed by using a transparent conductive material. The emission light from the first to third EL elements 112 to 114 appears outside through the electrode formed by the transparent conductive material which of the first electrode of the first EL element 112 and the second electrode of the third EL element 114.

Figure 9:
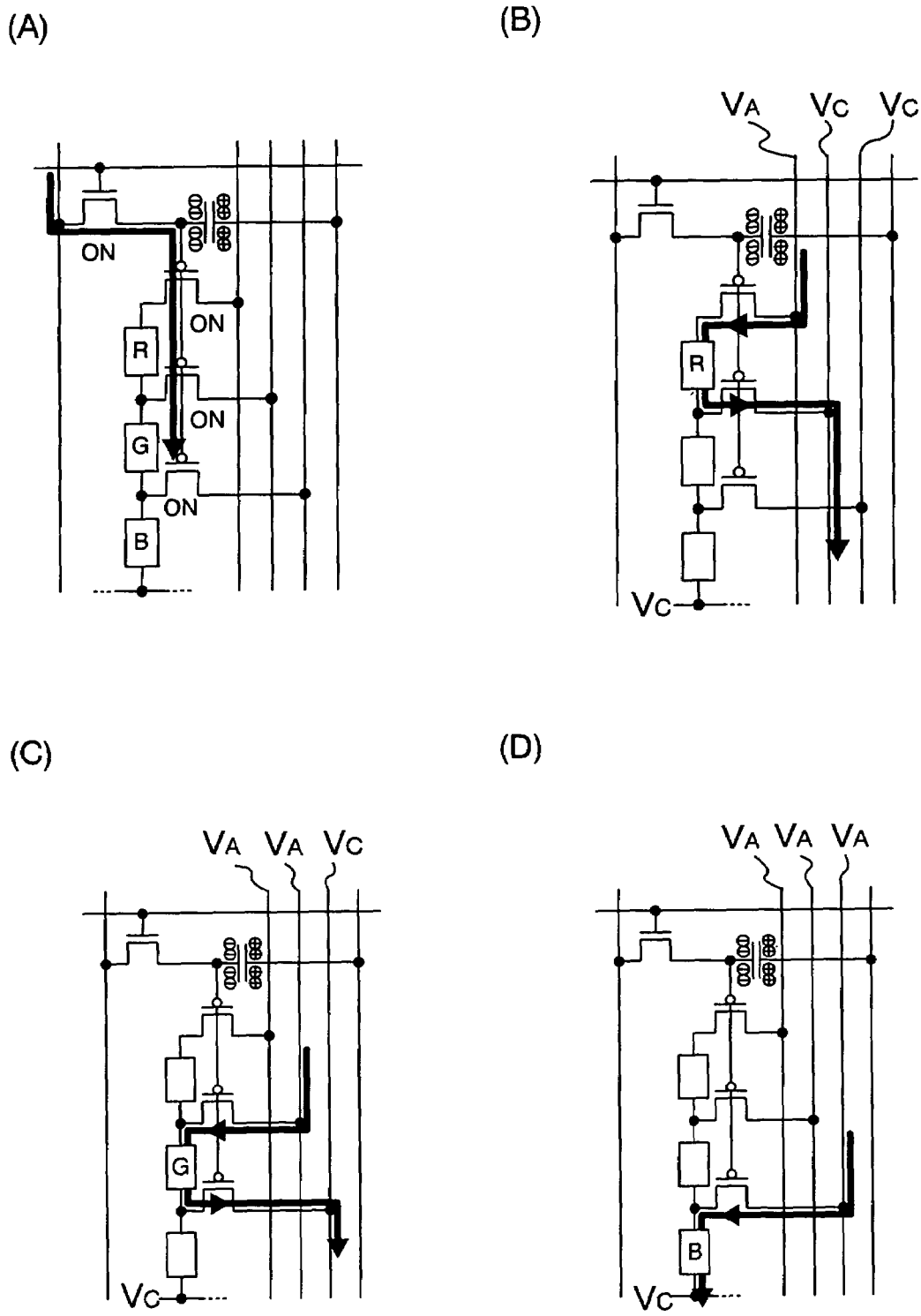
FIG. 9 is a diagram describing light-emitting means in pixels of the present invention.

The light-emitting operation in the pixel portion will be described with reference to FIG. 1 and FIG. 9. Here, ON and OFF refer to the state of the TFT. By ON is meant a state where the absolute value of the voltage between the gate and the source of the TFT exceeds the absolute value of the threshold thereof, so that an electrical current flows between the source and the drain. By OFF is meant a state where the absolute value of the voltage between the gate and the source of the TFT is less than the absolute value of the threshold thereof, so that an electrical current does not flow between the source and the drain (does not include a minute leak current).

When the gate signal line 102 is selected, the TFT for switching 107 is turned ON and, as shown in FIG. 9(A), an image signal is inputted from the source signal line 101 to the gate electrodes of the first to third TFTs for driving 108 to 110 via the TFT for switching 107. In the example of FIG. 9(A), the TFT for switching 107 uses an N-type TFT and the first to third TFTs for driving 108 to 110 use P-type TFTs. Thus, when the potential of the image signal is an L potential, the first to third TFTs for driving 108 to 110 are turned ON.

Next, the light emission of the EL elements will be described. In the present invention, the EL elements are laminated. In the case of the configuration shown in FIG. 1, because the image signal is commonly inputted to the gate electrodes of the first to third TFTs for driving 108 to 110, control of the light emission/non-light emission of the EL elements is conducted by controlling the potentials of the first to third current supply lines 103 to 105.

First, a case will be described where the first emission color (R) is emitted (FIG. 9(B)). Now, the potential of the power line is an opposing voltage $V_C$, and the potentials of the first to third current supply lines 103 to 105 are $V_A$, $V_C$ and $V_C$ (where $V_C<V_A$).

In this case, with respect to the first EL element 112, the potential of the first electrode generally becomes $V_A$ and the potential of the second electrode generally becomes $V_C$. Thus, a difference in potential arises between the first electrode and the second electrode, an electrical current flows in via the first TFT for driving 108 and the first EL element 112 emits light. On the other hand, the potential of the first electrode of the second EL element 113 is generally $V_C$ because it is the potential of the second electrode of the first EL element 112, and the potential of the second electrode is also generally $V_C$. Thus, an electrical current does not flow to the second EL element 113. Namely, the second EL element 113 does not emit light at this time. Thus, the electrical current flowing to the first EL element 112 from the first current supply line 103 flows to the second current supply line 104 via the second TFT 109 for driving. Similarly, with respect to the third EL element 114, an electrical current does not flow thereto because there is no difference in potential between the first electrode and the second electrode. Namely, it does not emit light.

Next, a case will be described where the second emission color (G) is emitted (FIG. 9(C)). Now, the potential of the power line is an opposing voltage $V_C$, and the potentials of the first to third current supply lines 103 to 105 are $V_A$, $V_A$ and $V_C$.

In this case, with respect to the first EL element 112, the potential of the first electrode generally becomes $V_A$ and the potential of the second electrode also generally becomes $V_A$. Thus, an electrical current does not flow to the first EL element 112. Namely, it does not emit light. On the other hand, with respect to the second EL element 113, the potential of the first electrode is generally $V_A$ because it is the potential of the second electrode of the first EL element 112, and the potential of the second electrode is generally $V_C$. Thus, a difference in potential arises between the first electrode and the second electrode, electrical current flows thereto via the second TFT for driving 109, and the second EL element 113 emits light. Also, with respect to the third EL element 114, the potential of the first electrode is generally $V_C$ and the potential of the second electrode is also $V_C$. Thus, an electrical current does not flow thereto because there is no difference in potential between the first electrode and the second electrode. Namely, it does not emit light.

Next, a case will be described where the third emission color (B) is emitted (FIG. 9(D)). Now, the potential of the power line is an opposing voltage $V_C$, and the potentials of the first to third current supply lines 103 to 105 are all $V_A$.

In this case, with respect to the first EL element 112, the potential of the first electrode generally becomes $V_A$ and the potential of the second electrode also generally becomes $V_A$. Thus, an electrical current does not flow to the first EL element 112. Namely, it does not emit light. Similarly, with respect to the second EL element 113, the electrical current does not flow thereto because there is no difference in potential between the first electrode and the second electrode. Namely, it does not emit light. On the other hand, with respect to the third EL element 114, the potential of the first electrode generally becomes $V_A$ and the potential of the second electrode is $V_C$. Thus, a difference in potential arises between the first electrode and the second electrode, electrical current flows thereto via the third TFT for driving 110, and the third EL element 114 emits light.

Due to the above operation, the EL elements formed by lamination can be made to selectively emit light. In the above description, the difference in potential between the first electrodes and the second electrodes of the first to third EL elements 112 to 114, i.e. the voltage between the anode/cathode is $V_A$-$V_C$, but because it is common in the case of EL elements for the voltage between the anode and cathode necessary to obtain an identical luminance to be different due to the emission colors, the present invention is not limited to the above-described conditions. In other words, an appropriate voltage may be set depending on the characteristics of the EL elements.

Here, as an example, a case was described that included light-emitting elements of the three colors of R, G and B used in a common color display device; however, the gist of the present invention lies in causing any one light-emitting element to selectively emit light for a certain period of time in a case that includes a plurality of light-emitting elements, so that realization of the present invention is easily possible with a similar technique even in the case of, for example, three or more colors. Thus, here the number of light-emitting elements is not particularly limited.

Also, although the first to third light-emitting elements have a laminate structure, the present invention can be applied even if the respective light-emitting elements are not necessarily laminated. However, with respect to being able to ensure a wide light-emitting region, it is preferable for them to have a laminate structure.

Embodiment Mode 2

Figure 2:
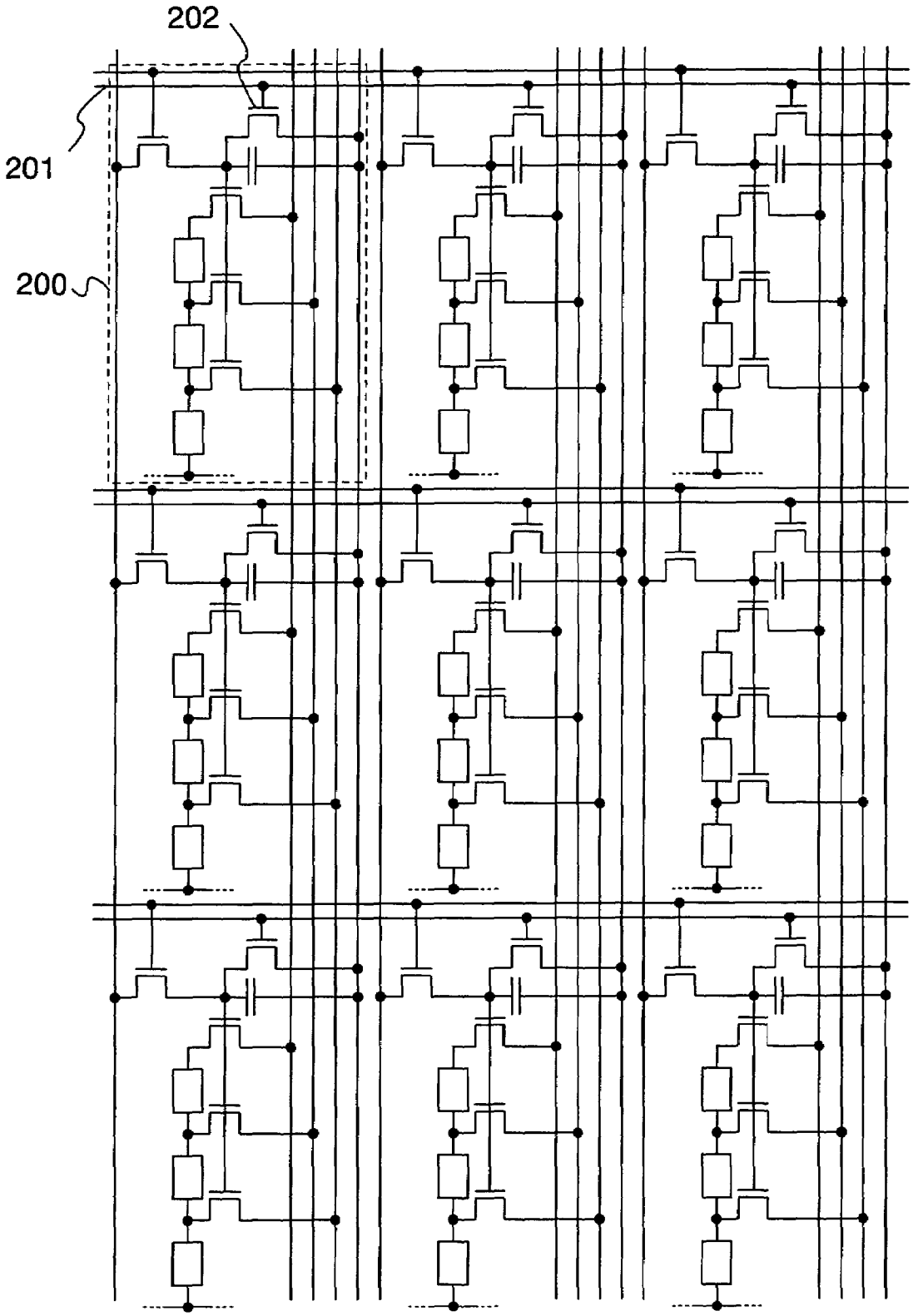
FIG. 2 is a diagram showing an embodiment mode of the present invention.

FIG. 2 shows an example where the present invention is applied to pixels of a configuration that is different from those of embodiment mode 1. A gate signal line for erasure 201 and a TFT for erasure 202 are added to the configuration shown in FIG. 1. Because the remaining configuration is in accordance with FIG. 1, numbers will be omitted.

With respect to the pixels of the configuration shown in FIG. 2, the EL elements emitting light can be forcibly placed in a non-light-emitting state at a desired timing in order to control the emission time when conducting display according to the digital time gradation described in Japanese Patent Laid-open No. 2001-343933. Specifically, a line selection pulse is outputted to the gate signal line for erasure 201 at the timing at which one desires to end light emission, whereby the TFT for erasure 202 is turned ON. Thus, the potentials of the gate electrodes of the TFTs for driving 108 to 110 become equal to the potential of the retention volume line and the TFTs for driving 108 to 110 are turned OFF. Thus, the paths by which the electrical currents are supplied to the EL elements are cut off and the EL elements are placed in a non-light-emitting state.

Here, it is necessary for the potential of the retention volume line 106 to be a potential at which the TFTs for driving 108 to 110 are reliably turned OFF. Specifically, in a case where the TFTs for driving 108 to 110 are P-type TFTs, the potential of the retention volume line 106 is made higher than the potentials of all the current supply lines. In other words, in a case where the potentials of the gate electrodes of the TFTs for driving 108 to 110 are equal to the potential of the retention volume line 106, the potential of the retention volume line 106 is configured so that the voltages between the gates/sources of the TFTs for driving 108 to 110 all become positive. Conversely, in a case where the TFTs for driving 108 to 110 are N-types, the potential of the retention volume line 106 may be made less than the potentials of all the current supply lines.

Here, the TFT for erasure 202 is disposed between the gate electrodes of the TFTs for driving 108 to 110 and the retention volume line 106, but it may also be disposed between the gate electrodes of the TFTs for driving 108 to 110 and any of the first to third current supply lines 103 to 105.

Figure 10:
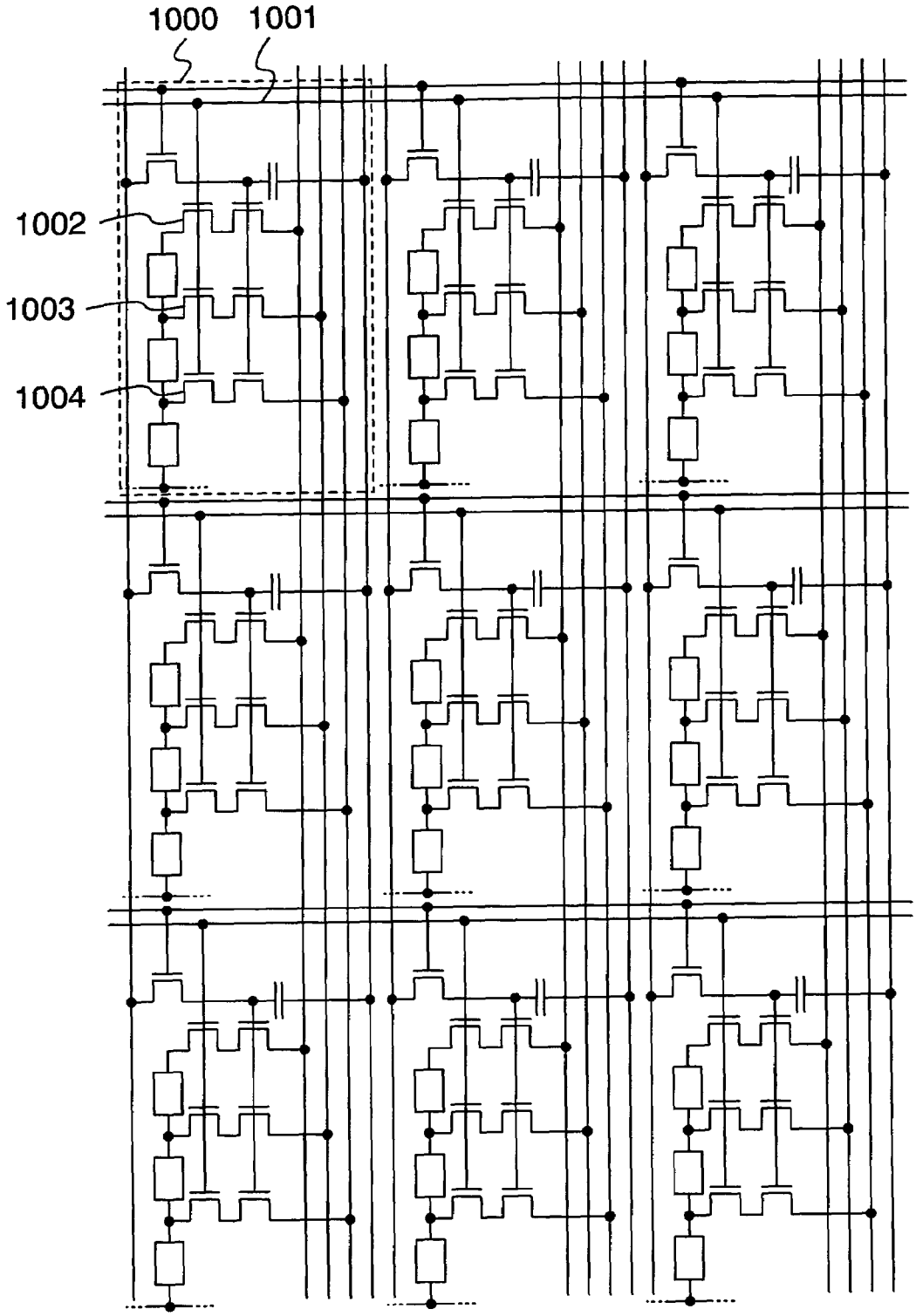
FIG. 10 is a diagram showing an embodiment mode of the present invention.

Also, the TFT for erasure 202 is not limited to the disposition in FIG. 2. It suffices as long as the TFT for erasure can be controlled at a desired timing so that the supply of the electrical current to the EL elements can be blocked. For example, as shown in FIG. 10, TFTs for erasure 1002 to 1004 can be disposed between the drain terminals of the TFTs for driving 108 to 110 and the EL elements, and with respect to the period in which the TFTs for erasure 1002 to 1004 are ON, the electrical current flows to the EL elements via any of the TFTs for driving 108 to 110, and the TFTs for erasure 1002 to 1004 are turned OFF at a desired timing, whereby the electrical current to the EL elements can be forcibly blocked.

EMBODIMENT

Embodiment 1

In the present embodiment, the configuration of a drive circuit for controlling pixels configured by using the present invention will be described.

Figure 6:
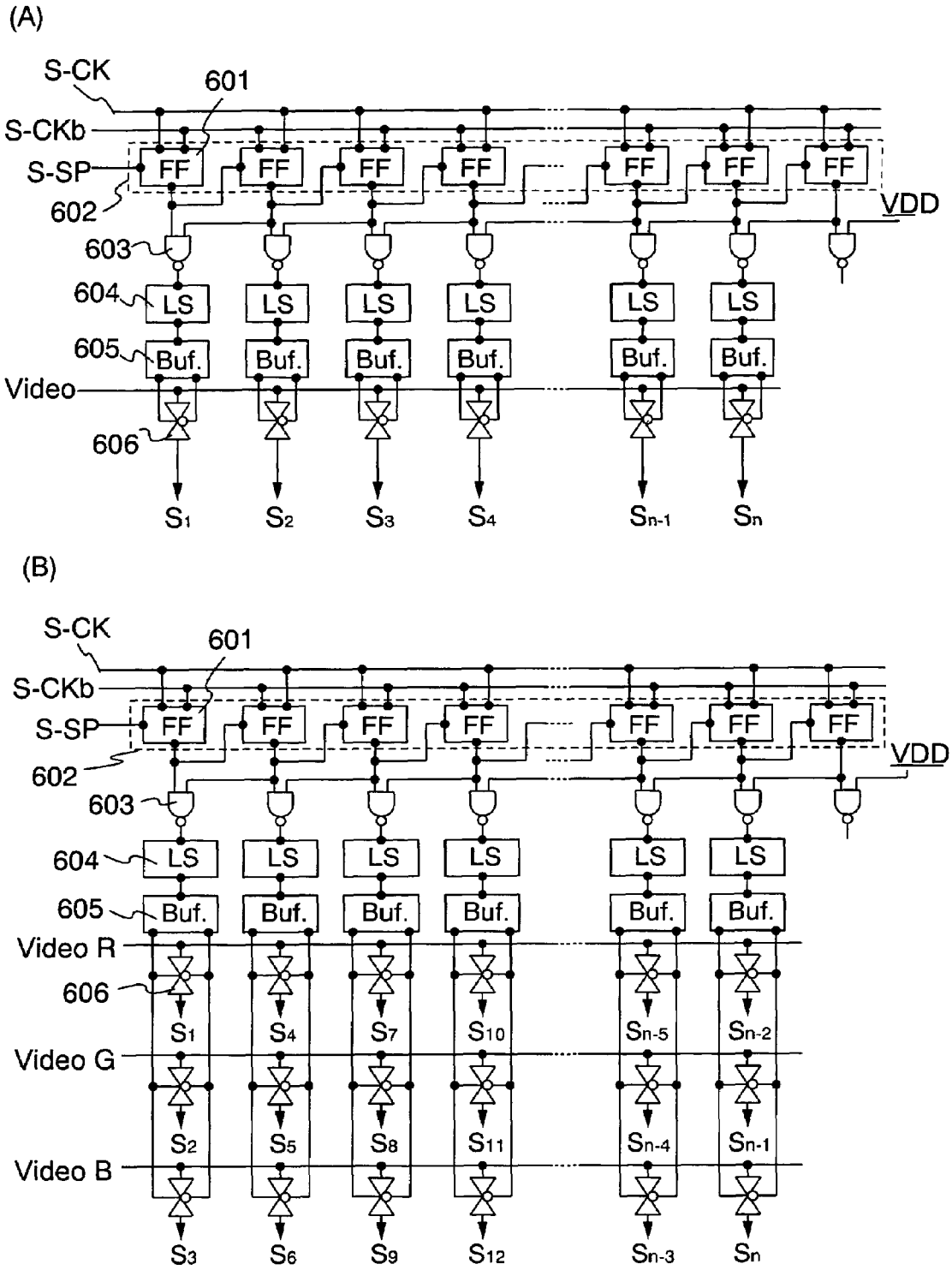
FIG. 6 is a diagram showing configuration examples of a source signal line drive circuit.

FIG. 6 shows a configuration example of a source signal line drive circuit for conducting display using analog image signals as mainly image signals.

In the example of FIG. 6(A), the source signal line drive circuit includes a shift register 602 using a plurality of flip-flops 601, NANDs 603, level shifters 604, buffers 605 and sampling switches 606.

The operation will be described. The shift register 602 sequentially outputs sampling pulses in accordance with clock signals (S-CK, S-CKb) and a start pulse (S-SP). Sometimes two continuous sampling pulses have a period in which their mutual pulses overlap. In such a case, computation is conducted with the before and after sampling pulses by the NANDs 603. Depending on the configuration of the shift register 602, sometimes the NANDs 603 are not necessary.

If necessary, the sampling pulses outputted from the NANDs 603 undergo amplitude conversion by the level shifters 604, are amplified by the buffers 605 and are inputted to the sampling switches 606. The sampling switches 606 fetch analog image signals (Video) being inputted at the timing at which the sampling pulses are inputted and point-sequentially output them to source signal lines $S_1$ to $S_n$.

Here, the level shifters 604 and the buffers 605 are not particularly necessary as long as the function of the shift register 602 itself or the NANDs 603 themselves driving a large load is sufficient.

The basic configuration of FIG. 6(B) is the same as that of FIG. 6(A), except that the buffers 605 drive a plurality of sampling switches 606 per column. By configuring the present invention in this manner, fetching of the image signals can be simultaneously conducted in a plurality of rows at the timing at which one sampling pulse is outputted, so that, in comparison to the configuration of FIG. 6(A), the operating frequency of the source signal line drive circuit can be lowered. Usually, driving so that fetching of the image signals is conducted by one sampling pulse simultaneously for k number of image signals is called k divisional driving, and as long as the number of source signal lines is the same, this suffices at an operating frequency of 1/k with respect to the configuration shown in FIG. 6(A). However, because the fetching of k number of image signals is simultaneously conducted, input of k number of image signals in parallel becomes necessary.

Figure 7:
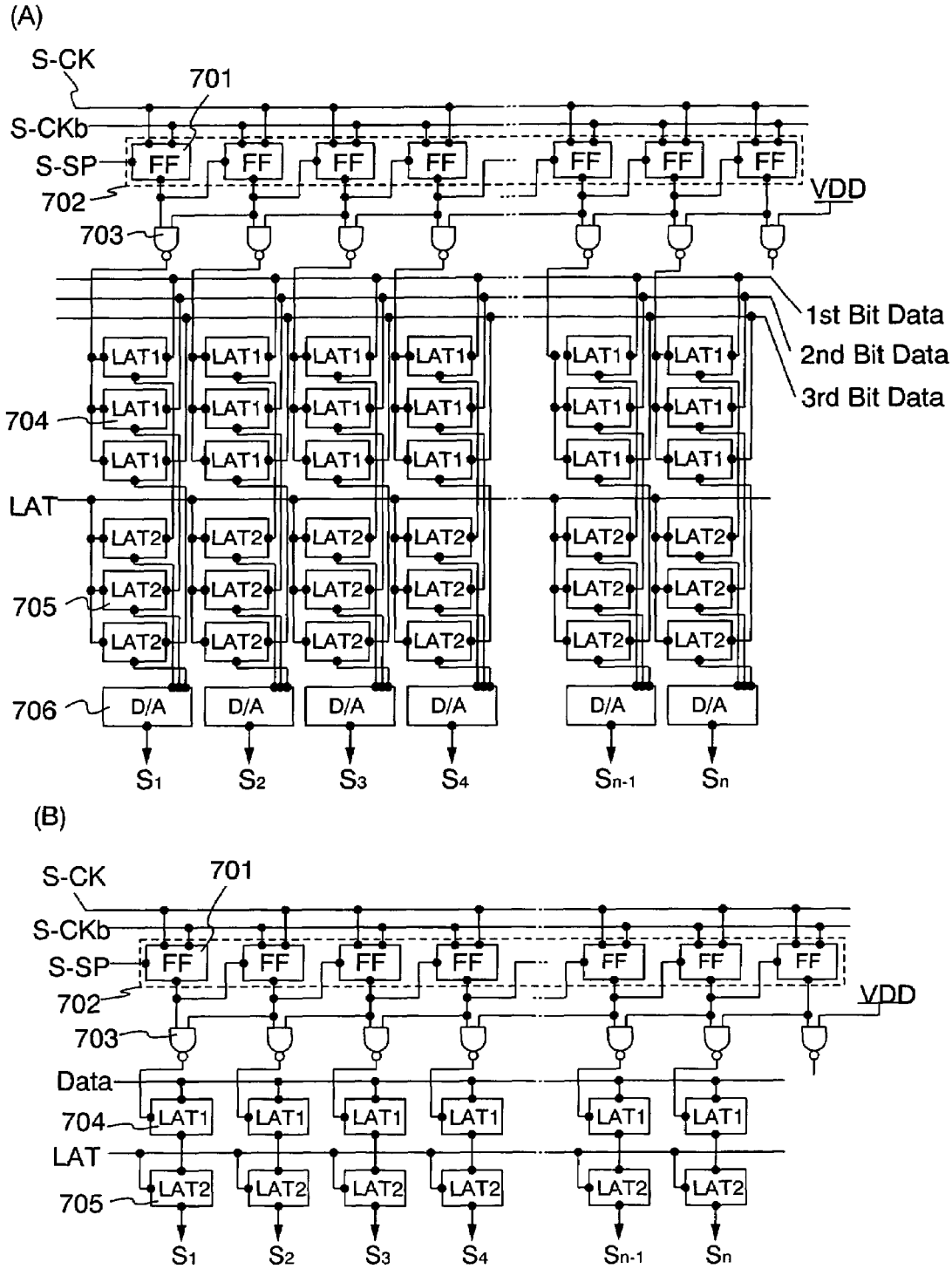
FIG. 7 is a diagram showing configuration examples of a source signal line drive circuit.

FIG. 7 shows a configuration example of a source signal line drive circuit for conducting display using digital image signals as mainly image signal.

In the example of FIG. 7(A), the source signal line drive circuit includes a shift register 702 using a plurality of flip-flops 701, NANDs 703, first latch circuits 704, second latch circuits 705 and D/A conversion circuits 706.

The operation will be described. However, the operations of the shift register to NANDs will be omitted because they are the same as that shown in FIG. 6.

Fetching of the digital image signals (Data) is conducted in the first latch circuits 704 in accordance with the timing at which the sampling pulses are inputted. Here, fetching of 3-bit digital image signals is simultaneously conducted by three parallel first latch circuits 704. The fetched digital image signals are retained in the respective first latch circuits 704.

The above-described operation is conducted in order beginning with the first row. When latch signals (LAT) are inputted after fetching of the digital image signals in the final row of first latch circuits 704 ends, the digital image signals being retained in the first latch circuits 704 are sent concurrently to the second latch circuits 705. Thereafter, the digital image signals of one line are processed in parallel.

The digital image signals sent to the second latch circuits 705 are next inputted to the D/A conversion circuits 706, undergo D/A conversion, are converted to analog voltage signals and outputted to the source signal lines $S_1$ to $S_n$.

In the example of FIG. 7(B), a configuration in the case of conducting display by digital time gradation is shown. The first latch circuits 704 and the second latch circuits 705 are singly disposed per one row, and the digital image signals (Data) are serially inputted from one signal line. As an example, they are inputted in the following manner: first bit data of the first row→first bit data of second row→. . . →first bit data of final row→second bit data of first row→second bit data of second row→. . . →second bit data of final row→. . . last bit data of first row→last bit data of second row→. . . →last bit data of final row; but the manner of input is not limited to this. Because the operation of each part is the same as in FIG. 7(A), description thereof will be omitted here.

Figure 8:
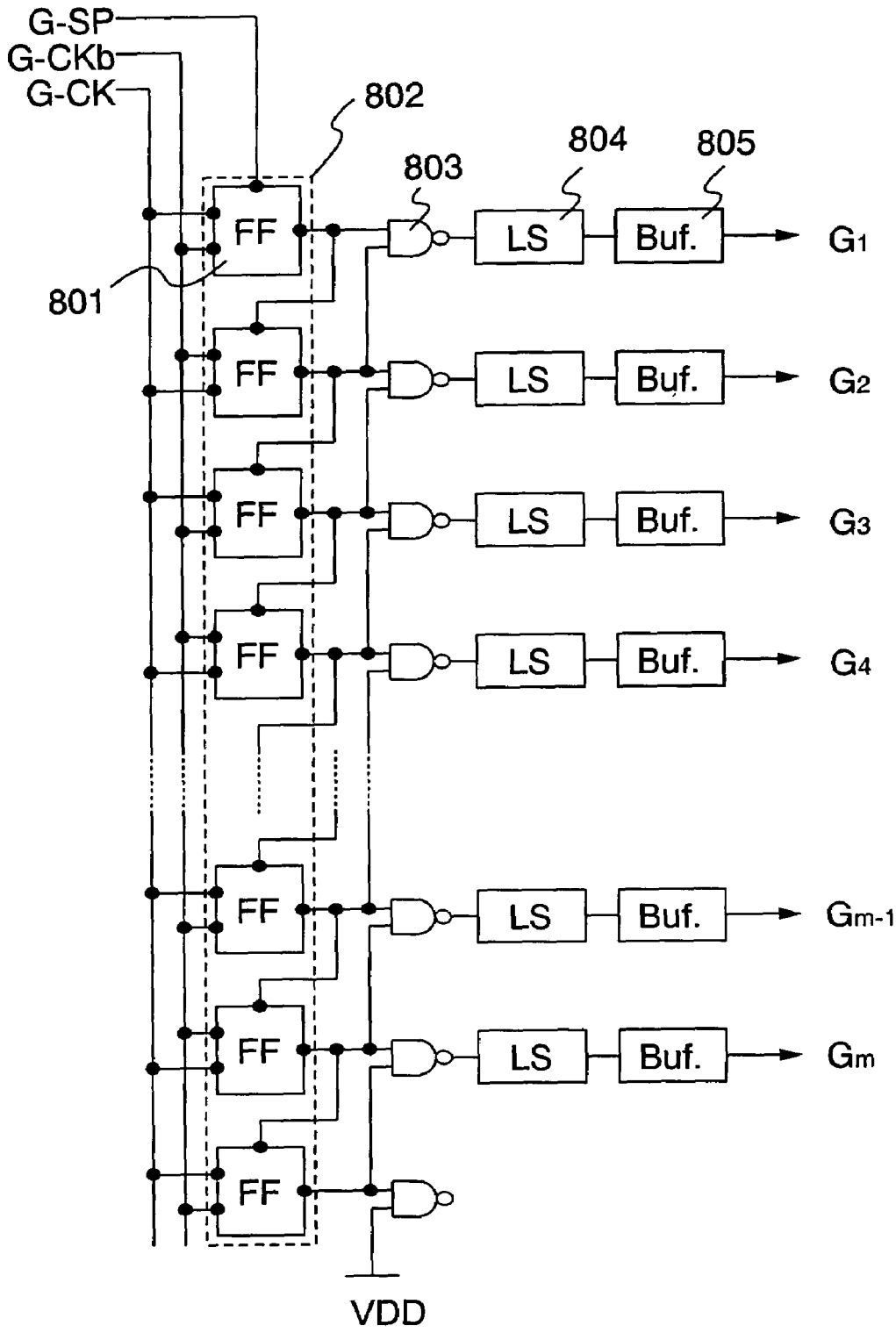
FIG. 8 is a diagram showing a configuration example of a source signal line drive circuit.

FIG. 8 shows a configuration example of a gate signal line drive circuit.

In the example of FIG. 8, the gate signal line drive circuit includes, similar to the source signal line drive circuit, a shift register 802 using a plurality of flip-flips 801, NANDs 803, level shifters 804 and buffers 805. Here also, similar to the case of the source signal line drive circuit, the NANDs 803 the level shifters 804 and the buffers 805 may be disposed as necessary.

With respect to the operation also, similar to that which was described in the section on the source signal line drive circuit, line selection pulses are sequentially outputted from the shift register 802, computation between adjacent pulses is conducted in the NANDs 803, the pulses undergo amplitude conversion in the level shifters 804, are outputted to gate signal lines $G_1$ to $G_m$ via the buffers 805 and selected in order beginning with the first line. The gate signal line drive circuit may also be used in combination with any of the above-described source signal line drive circuits.

Embodiment 2

Figure 3:
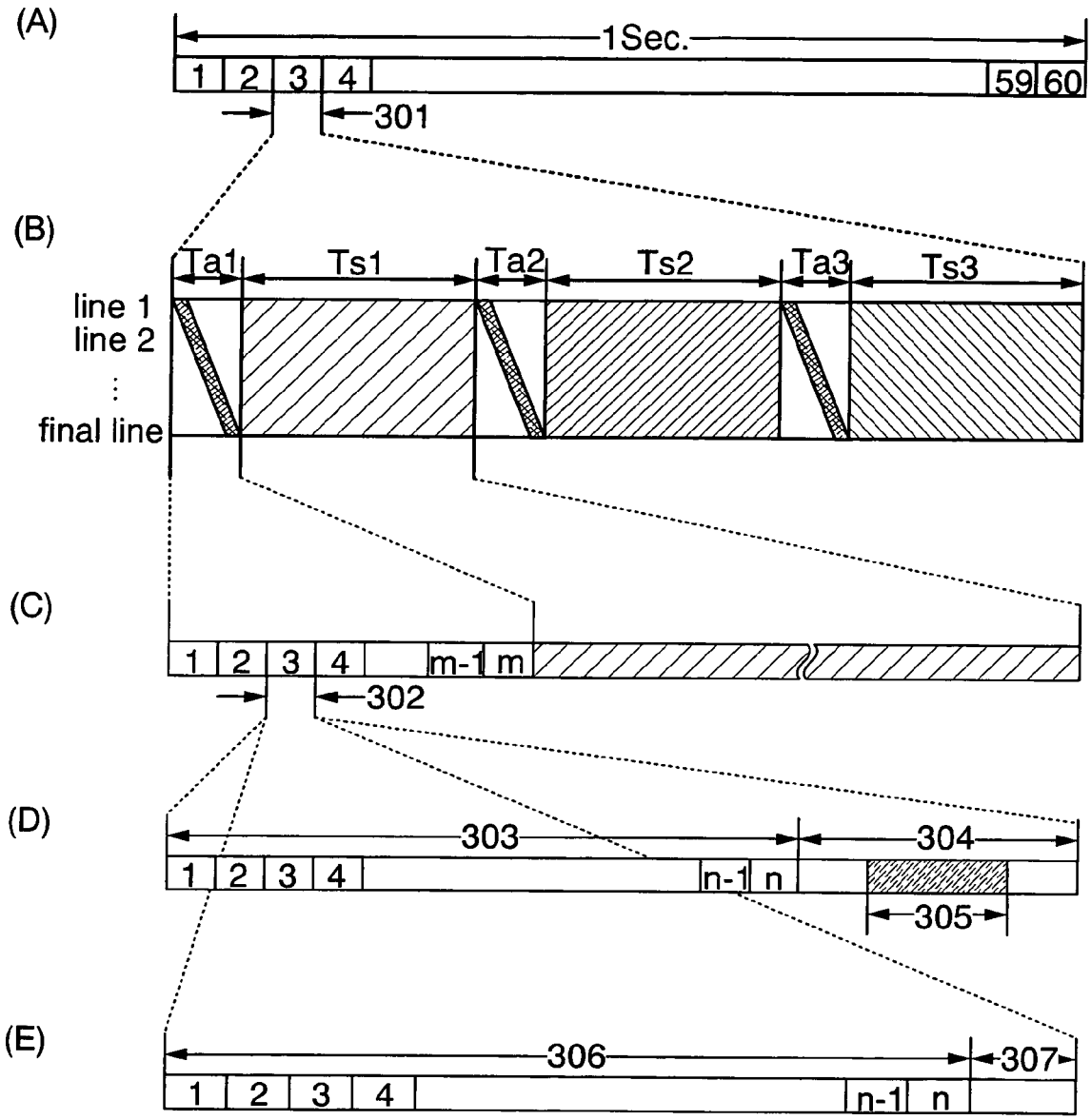
FIG. 3 is a diagram describing a timing of field sequential driving.

The operational timing when display is conducted using the configuration of the present invention will be described using FIG. 3.

As shown in FIG. 3(A), rewriting of the screen and display are repeatedly conducted in a display period in the display device. The number of times of rewriting is usually about 60 per second, so that the viewer does not perceive flickering. Here, the period in which the series of operations of rewriting and display of the screen are conducted one time, i.e. the period represented by 301 in FIG. 3(A) will be described as one frame period.

In the present invention, image signals to the pixels emitting the first to third emission colors are inputted from a common source signal line. Thus, because it is necessary to conduct writing at different periods per emission color, the field sequential format is used. In other words, as shown in FIG. 3(B), one frame period is divided into three periods, and writing and light emission are conducted per emission color in the respective periods. To the viewer, the colors are perceived as being mixed due to the afterimage effect, so that multicolor display becomes possible.

In FIG. 3(B), the periods represented by Ta1 to Ta3 are periods in which the image signals are written to the pixels, and will hereafter be referred to as address (writing) periods. The periods represented by Ts1 to Ts3 are periods in which light is emitted at a desired luminance in response to the written image signals, and will hereafter be referred to as sustain (light emission) periods. With respect to the address (writing) periods, as shown in FIG. 3(C), line selection is conducted from line 1 sequentially to line m (final line). Here, the period represented by 302, i.e. the selection period per one line will be referred to as one horizontal period. Writing of dot data of n rows is conducted within one horizontal period.

FIG. 3(D) is an example of a case where writing of dot data within one horizontal period is conducted in a line sequence. As described in Embodiment 1, sampling of dot data from the first row sequentially to the n-th row is conducted in the first latch circuits in the period represented by 303, and when sampling of the data of one line ends, latch pulses are inputted at the timing represented by 305 during the flyback period represented by 304, and at this time the data of one line are sent altogether to the second latch circuits.

FIG. 3(E) is an example of a case where writing of dot data within one horizontal period is conducted in a point sequence. As described in Embodiment 1, sampling of dot data from the first row sequentially to the n-th row is conducted in the period represented by 306, and in each row the data is immediately outputted to the source signal line.

The above is the operation in analog gradation. Next, the operation in digital time gradation will be described.

Figure 4:
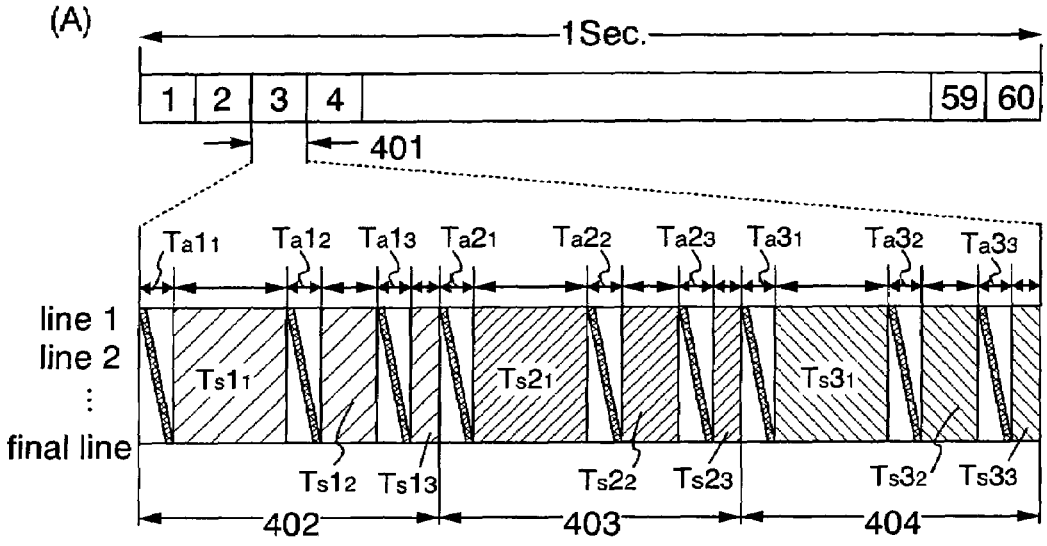
FIG. 4 is a diagram describing timings where digital time gradation and field sequential driving are combined.
Figure 4:
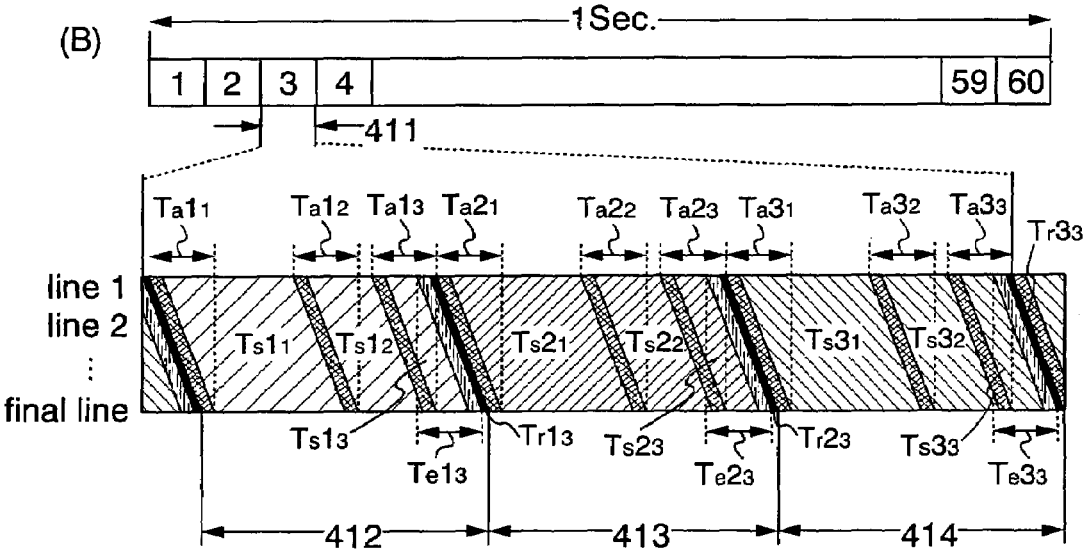
Figure 5:
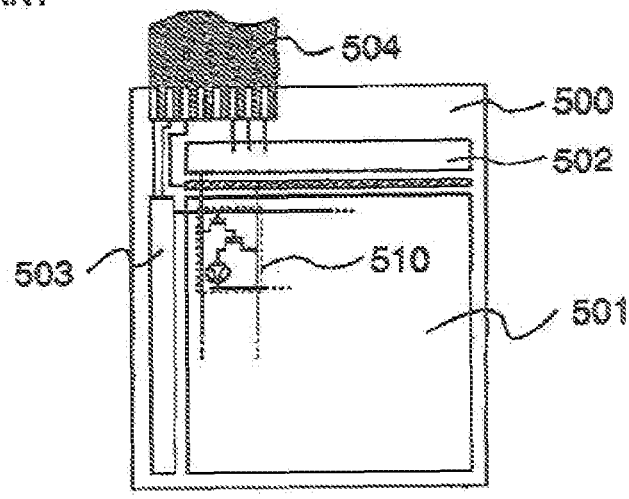
FIG. 5 is a diagram showing the configuration of a conventional display device.
Figure 5:
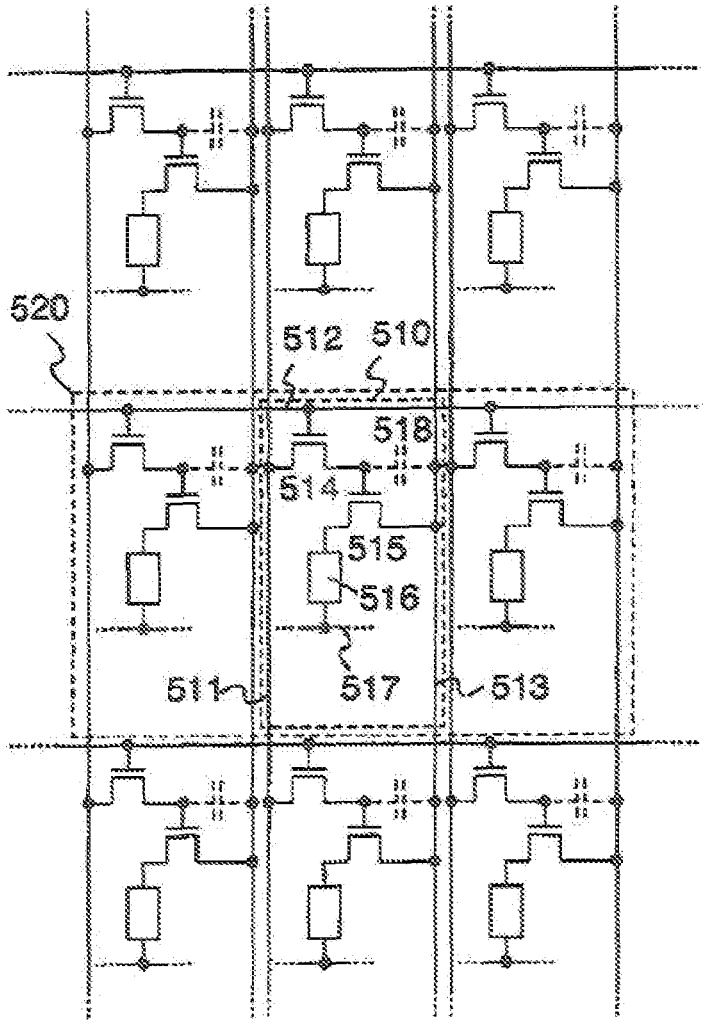

As shown in FIG. 4(A), the field sequential format is also used in digital time gradation. One frame period represented by 401 in FIG. 4(A) is divided into three periods represented by 402 to 404, and writing and display in each emission color are conducted in each period.

Here, as an example, a case using 3-bit digital image signals will be described. In the case of digital time gradation, the frame period 302 is further divided into a plurality of sub-frame periods. Here, because the data are 3-bit, they are divided into the three subframe periods.

Each subframe period includes an address (writing) period Ta# (# is a natural number) and a sustain (light emission) period Ts#. In FIG. 4(A), the lengths of the sustain (light emission) periods are such that Ts1:Ts2:Ts3=4:2:1, and a $2^3$=8 gradation is expressed by controlling the light emission or non-light emission in each sustain (light emission) period. In other words, the lengths of the sustain (light emission) periods become a ratio of the power of two, so that Ts1:Ts2:Ts3=$2^{(n-1)}$:$2^{(n-2)}$:. . . :$2^1$:$2^0$. For example, in a case where only Ts3 emits light and Ts1 and Ts2 do not emit light, only about 14% of all the sustain (light emission) periods emit light. Namely, a luminance of about 14% can be expressed. In a case where Ts1 and Ts2 emit light and Ts3 does not emit light, only about 86% of all the sustain (light emission) periods emit light. Namely, a luminance of about 86% can be expressed.

By repeating this operation with respect to the first to third emission colors, multicolor display can be realized by the afterimage effect with respect to the viewer.

According to this format, because the address (writing) periods and the sustain (light emission) periods are completely separate, there is the advantage that the lengths of the sustain (light emission) periods can be freely set, but as writing is being conducted in a certain line in an address (writing) period, writing and light emission are not conducted in other lines. In other words, the duty ratio drops overall.

Thus, an operation at the timing shown in FIG. 4(B) where the address (writing) periods and the sustain (light emission) periods are not separated will be described.

The operation here is the same in that one frame period represented by 411 in FIG. 4(B) is divided into three frame periods represented by 412 to 414, but is different in that the address (writing) periods and the sustain (light emission) periods are not divided in each sub-frame period. In other words, when writing at line i is completed, light emission immediately begins at line i. Thereafter, as writing at line i+1 is being conducted, line i is already in the sustain (light emission) period. By configuring the present invention with this timing, the duty ratio can be raised.

However, in the case of the timing of FIG. 4(B), when the sustain (light emission) period is shorter than the address (writing) period, a period arises where the address (writing) period in a certain sub-frame period overlaps with the address (writing) period in the next sub-frame period. Thus, as shown in FIG. 2 and FIG. 10, erasure periods Tr1$_3$, Tr2$_3$ and Tr3$_3$ are forcibly disposed using the TFT for erasure from the point in time when the sustain (light emission) period ends to when the next address (writing) period begins. Due to these erasure periods, address (writing) periods in different sub-frame periods can be prevented from overlapping. Specifically, selection pulses for erasure are outputted using the second gate signal line drive circuit for controlling the TFTs for erasure so that the TFTs for erasure are turned ON at a desired timing in order beginning with the first line. It should be noted that the second gate signal line drive circuit may have the same configuration as the first gate signal line drive circuit that conducts ordinary writing. Thus, the lengths of periods Te1$_3$, Te2$_3$ and Te3$_3$ that conduct writing of erasure signals (hereinafter referred to as reset periods) are equal to those of the address (writing) periods.

Here, a case where the number of gradation display bits was the same as the number of sub-frames was used as an example, but they may be divided into more periods. It is also possible to realize gradation even if the ratio of the lengths of the sustain (light emission) periods is not the power of two.

Embodiment 3

Figure 11:
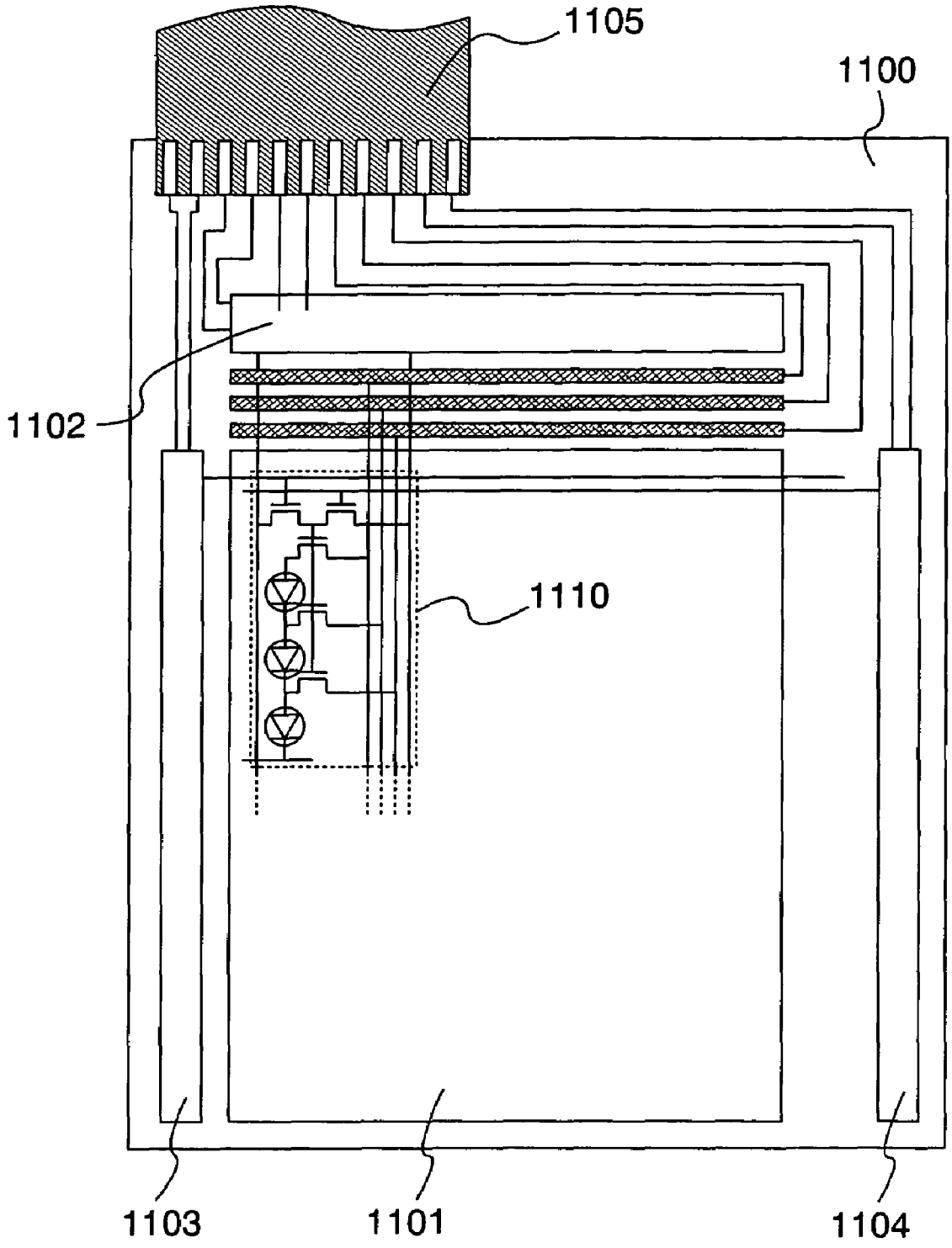
FIG. 11 is a diagram showing an embodiment mode of the present invention.

Using FIG. 11, the configuration of a display device for driving pixels including a TFT for erasure such as shown in FIG. 2 and FIG. 10 will be described.

A pixel portion 1101, a source signal line drive circuit 1102, a first gate signal line drive circuit 1103 and a second gate signal line drive circuit 1104 are formed on a substrate 1100. Input of signals to the drive circuits and supply of an electrical current to the pixel portion 1101 are conducted from the outside via a flexible printed circuit (FPC) 1105. The portion represented by the dotted frame 1110 is one pixel.

The first gate signal line drive circuit 1103 and the second gate signal line drive circuit 1104 are disposed facing each other with the pixel portion 1101 sandwiched therebetween. The circuit configuration and operating frequency may be the same for both the first gate signal line drive circuit 1103 and the second gate signal line drive circuit 1104.

Embodiment 4

Figure 12:
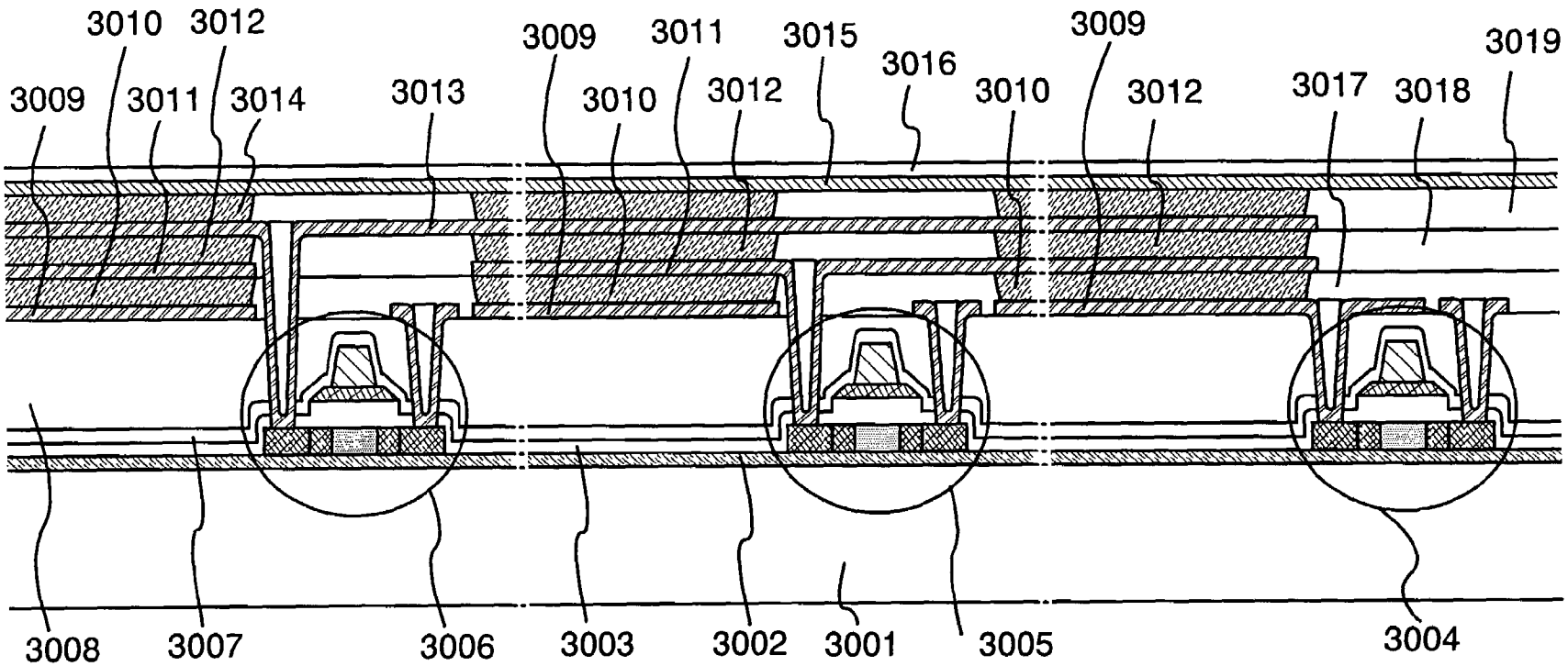
FIG. 12 is a diagram showing an embodiment mode of the present invention.

Using FIG. 12, an example of the cross-sectional configuration of the pixel portion of the display device of the present invention will be described.

A base film 3002 is formed on an insulating substrate 3001 (a flexible substrate is also possible) such as quartz, non-alkaline glass or plastic, and an active element group including first to third TFTs for driving 3004 to 3006 is formed thereon. 3003 is a gate insulating film of the TFTs 3004 to 3006. Moreover, first and second interlayer insulating films 3007 and 3008 are formed, and after contact holes are formed in the insulating films, wiring (not shown) and first pixel electrodes 3009 are formed.

Next, an organic resin film represented by acryl or an inorganic film such as silicon oxide or silicon oxide nitride film is formed as a first edge cover film 3017, and the portions where a first EL layer 3010 is to be formed are opened. Next, the first EL layer 3010 is formed at the open portions. In this case, the inkjet method is preferable as the method of forming the EL layer. However, the EL layer may also be formed by another method as long as the coating position can be precisely controlled.

Thereafter, second pixel electrodes 3011 are formed, and from then on, a second edge cover film 3018 is formed similarly to the first edge cover film 3017, and the portions where a second EL layer 3012 is to be formed are opened. Next, the second EL layer 3012 is formed at the open portions.

Thereafter, third pixel electrodes 3013 are formed, and from then on, a third edge cover film 3019 is formed similarly to the second edge cover film 3018, and the portions where a third EL layer 3014 is to be formed are opened. Next, the third EL layer 3014 is formed at the open portions.

Next, an opposing electrode 3015 is formed. Here, in a case of a structure where the emission light from the EL layers appears at the substrate 3001 side where the active element group is formed (bottom emission), it is necessary for the first to third pixel electrodes 3009, 3011 and 3013 to be transparent. For example, they may be formed using a transparent conductive material such as ITO, or extremely thin electrodes may be formed using a metal material with a low resistance so that they are transparent. In contrast, in a case of a structure where the emission light from the EL layers appears in the direction opposite from the substrate 3001 where the active element group is formed (top emission), it is necessary for the second and third pixel electrodes 3011 and 3013 and the opposing electrode 3015 to be transparent. Moreover, in a case of a structure where the emission light from the EL layers appears at both the substrate 3001 side where the active element group is formed and the opposite side (dual emission), it is necessary for the first to third pixel electrodes 3009, 3011 and 3013 and the opposing electrode 3015 to be transparent.

Finally, a barrier film 3016 for preventing moisture from penetrating the first to third EL layers 3010, 3012 and 3014 is formed to make the display device. The first EL element 112 in FIG. 1 is formed by the first pixel electrode 3009, the first EL layer 3010 and the second pixel electrode 3011, the second EL element 113 in FIG. 1 is formed by the second pixel electrode 3011, the second EL layer 3012 and the third pixel electrode 3013, and the third EL element 114 in FIG. 1 is formed by the third pixel electrode 3013, the third EL layer 3014 and the opposing electrode 3015.

Embodiment 5

The semiconductor device of the present invention has many uses. In the present embodiment, examples of electronic apparatuses to which the present invention can be applied will be described.

Figure 13:
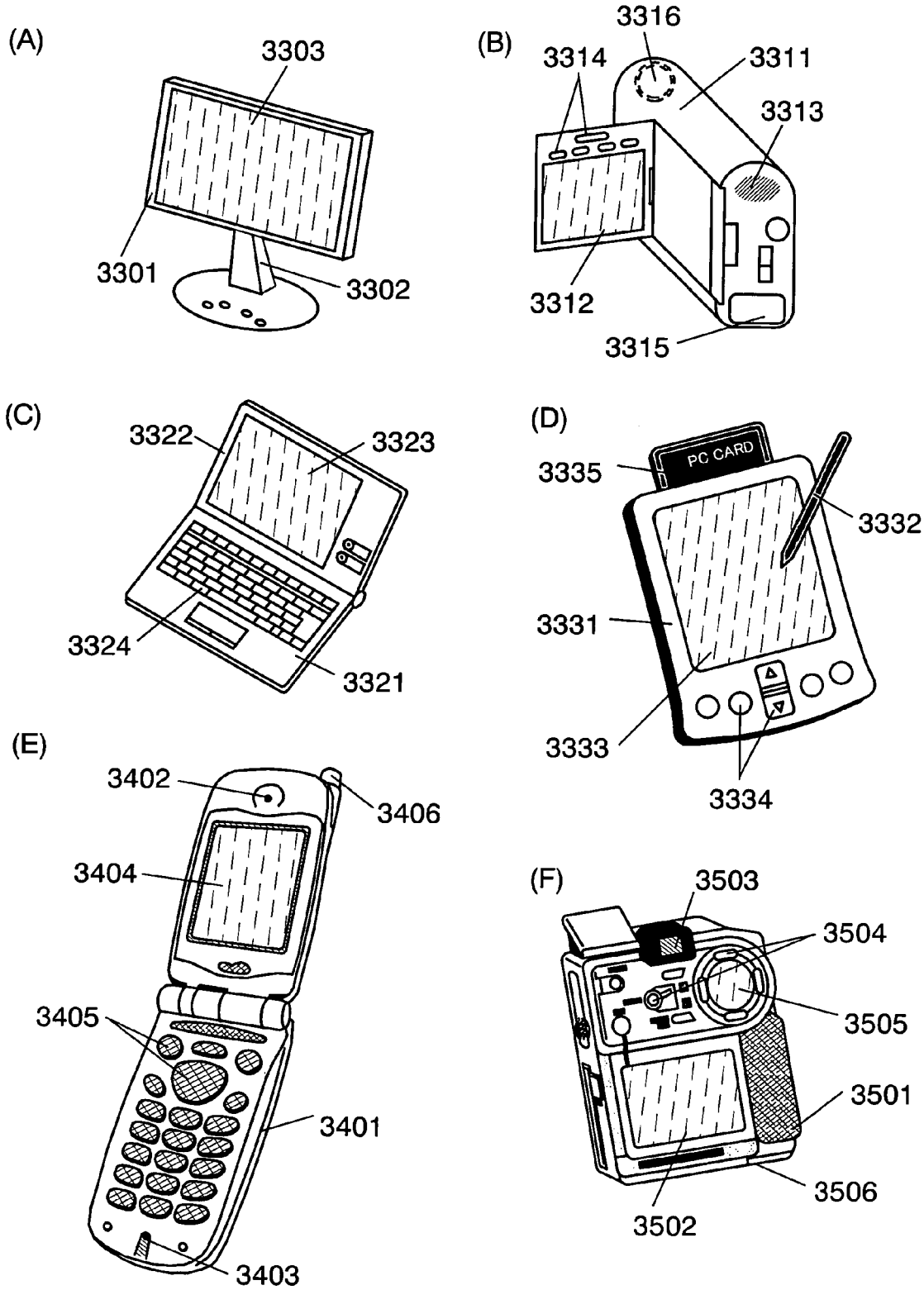
FIG. 13 is a diagram showing examples of electronic apparatuses to which the present invention can be applied.

Examples of such electronic apparatuses include portable information terminals (personal digital assistants, mobile computers, mobile telephones, etc.), video cameras, digital cameras, personal computers and televisions. Examples of these are shown in FIG. 13.

FIG. 13(A) shows an EL display that includes a casing 3301, a stand 3302 and a display portion 3303. The display device of the present invention can be used in the display portion 3303.

FIG. 13(B) shows a video camera that includes a main body 3311, a display portion 3312, an audio input portion 3313, operating switches 3314, a battery 3315 and an image receiving portion 3316. The display device of the present invention can be used in the display portion 3312.

FIG. 13(C) shows a personal computer that includes a main body 3321, a casing 3322, a display portion 3323 and a keyboard 3324. The display device of the present invention can be used in the display portion 3323.

FIG. 13(D) shows a portable information terminal that includes a main body 3331, a stylus 3332, a display portion 3333, operating buttons 3334 and an external interface 3335. The display device of the present invention can be used in the display portion 3333.

FIG. 13(E) shows a mobile telephone that includes a main body 3401, an audio output portion 3402, an audio input portion 3403, a display portion 3404, operating switches 3405 and an antenna 3406. The display device of the present invention can be used in the display portion 3404.

FIG. 13(F) shows a digital camera that includes a main body 3501, a display portion (A) 3502, an eyepiece 3503, operating switches 3504, a display portion (B) 3505 and a battery 3506. The display device of the present invention can be used in the display portion (A) 3502 and the display portion (B) 3505.

As described above, the application range of the present invention is extremely wide, and the invention can be used in electronic apparatuses in every field. Also, any of the configurations described in Embodiment 1 to Embodiment 4 may be used in the electronic apparatuses of the present example.

Industrial Applicability

By making the three colors of RGB into a laminate structure, the current density at each pixel can be lowly suppressed and the aperture ratio per pixel can be raised. Thus, this can contribute to prolonging the life of EL elements.

The invention claimed is:

1. A display device comprising:

a pixel comprising:

first to (n+1)th pixel electrodes;

first to n-th light-emitting layers that emit different emission colors; and first to n-th transistors for driving;

first to n-th current supply lines; and a power line;

wherein:

the first to n-th light-emitting layers and the first to (n+1)th pixel electrodes are laminated, the m-th light emitting layer is interposed between the m-th pixel electrode and the (m+1) pixel electrode, the m-th pixel electrode is electrically connected to the m-th current supply line via the m-th transistor for driving, the (n+1)th pixel electrode is electrically connected to the power line, the potential difference between the pixel electrodes sandwiching the m-th light-emitting element is sequentially adjusted so that the m-th light-emitting element selectively emits light, n is a natural number, $2 \leqq n$, and m is a natural number, $1 \leqq m \leqq n$.

2. The display device according to claim 1, wherein the second to n-th pixel electrodes all comprise a transparent substance.

3. The display device according to claim 1, wherein the display device is one selected from the group consisting of an EL display, a video camera, a personal computer, a portable information terminal, a mobile telephone, and a digital camera.

4. A display device comprising:

a pixel comprising:

first to (n+1)th pixel electrodes;

first to n-th light-emitting layers that emit different emission colors;

a transistor for switching; and first to n-th transistors for driving;

a source signal line;

a gate signal line;

first to n-th current supply lines; and a power line;

wherein:

the first to n-th light-emitting layers and the first to (n+1)th pixel electrodes are laminated, the m-th light emitting layer is interposed between the m-th pixel electrode and the (m+1)th pixel electrode, a gate electrode of the transistor for switching is electrically connected to the gate signal line, a first electrode of the transistor for switching is electrically connected to the source signal line, a second electrode of the transistor for switching is electrically connected to gate electrodes of the first to n-th transistors for driving, the m-th pixel electrode is electrically connected to the m-th current supply line via the m-th transistor for driving, the (n+1)th pixel electrode is electrically connected to the power line, the potential difference between the pixel electrodes sandwiching the m-th light-emitting element is sequentially adjusted so that the m-th light-emitting element selectively emits light, n is a natural number, $2 \leqq n$, and m is a natural number, $1 \leqq m \leqq n$.

5. The display device according to claim 4, further comprising:

a gate signal line for erasure;

wherein:

the pixel further comprises a transistor for erasure, the gate electrode of the transistor for erasure is electrically connected to the signal line for erasure, the first electrode of the transistor for erasure is electrically connected to the gate electrodes of the first to n-th transistors for driving, and the second electrode of the transistor for erasure is electrically connected to any one of the first to n-th current supply lines.

6. The display device according to claim 5, wherein the second to n-th pixel electrodes all comprise a transparent substance.

7. The display device according to claim 4, further comprising:

a gate signal line for erasure; and a retention volume line;

wherein:

the pixel further comprises a transistor for erasure, the gate electrode of the transistor for erasure is electrically connected to the gate signal line for erasure, the first electrodes of the transistor for erasure is electrically connected to the gate electrodes of the first to n-th transistors for driving, and a second electrode of the transistor for erasure is electrically connected to the retention volume line.

8. The display device according to claim 7, wherein the second to n-th pixel electrodes all comprise a transparent substance.

9. The display device according to claim 4, further comprising:

a gate signal line for erasure;

wherein:

the pixel further comprises first to n-th transistors for erasure, the gate electrodes of the first to n-th transistors for erasure are electrically connected to the gate signal line for erasure, and the first to n-th transistors for erasure are disposed between the first to n-th pixel electrodes and the first to n-th transistors for driving.

10. The display device according to claim 9, wherein the second to n-th pixel electrodes all comprise a transparent substance.

11. The display device according to claim 4, wherein the second to n-th pixel electrodes all comprise a transparent substance.

12. The display device according to claim 4, wherein the display device is one selected from the group consisting of an EL display, a video camera, a personal computer, a portable information terminal, a mobile telephone, and a digital camera.

* * * * *